United States Patent [19]

Frushour

[11] Patent Number: 5,011,515

[45] Date of Patent: Apr. 30, 1991

[54] COMPOSITE POLYCRYSTALLINE DIAMOND COMPACT WITH IMPROVED IMPACT RESISTANCE

[76] Inventor: Robert H. Frushour, P.O. Box 818, Plymouth, Mich. 48170

[21] Appl. No.: 390,208

[22] Filed: Aug. 7, 1989

[51] Int. Cl.[5] ..... E21B 10/46

[52] U.S. Cl. ..... 51/307; 51/309; 407/118; 407/119

[58] Field of Search ..... 407/116, 117, 118, 119, 407/120; 51/293, 295, 307, 308, 309; 175/329, 330

[56] References Cited

U.S. PATENT DOCUMENTS

| | | | |
|---|---|---|---|
| Re. 32,380 | 3/1987 | Wentorf | 407/119 |
| 2,944,323 | 7/1960 | Stadler | 407/119 |
| 3,745,623 | 7/1973 | Wentorf, Jr. et al. | 407/119 |
| 4,592,433 | 6/1986 | Dennis | 51/309 |
| 4,604,106 | 8/1986 | Hall et al. | 51/293 |
| 4,626,407 | 12/1986 | Veltri et al. | 407/119 |
| 4,629,373 | 12/1986 | Hall | 407/118 |
| 4,716,975 | 1/1988 | Dennis | 407/118 |
| 4,784,023 | 11/1988 | Dennis | 407/119 |

FOREIGN PATENT DOCUMENTS

| | | | |
|---|---|---|---|
| 114025 | 6/1940 | Australia | 407/118 |
| 7531715 | 5/1976 | France | 407/118 |

*Primary Examiner*—D. S. Meislin
*Assistant Examiner*—Blynn Shideler
*Attorney, Agent, or Firm*—Basile & Hanlon

[57] ABSTRACT

A compact blank for use in operations that require very high impact strength and abrasion resistance is disclosed. The compact comprises a substrate formed of tungsten carbide or other hard material with a diamond or cubic boron nitride layer bonded to the substrate. The interface between the layers is defined by topography with irregularities having non-planar side walls such that the concentration of substrate material continuously and gradually decreases at deeper penetrations into the diamond layer.

6 Claims, 3 Drawing Sheets

PRIOR ART

COMPOSITE POLYCRYSTALLINE DIAMOND COMPACT WITH IMPROVED IMPACT RESISTANCE

BACKGROUND OF THE INVENTION

1. Field of the Invention

The present invention relates to a sintered polycrystalline diamond composite for use in rock drilling, machining of wear resistant metals, and other operations which require the high abrasion resistance or wear resistance of a diamond surface. Specifically, this invention relates to such bodies which comprise a polycrystalline diamond layer attached to a cemented metal carbide substrate via processing at ultrahigh pressures and temperatures.

In the following disclosure and claims, it should be understood that the term polycrystalline diamond, PCD, or sintered diamond as the material is often referred to in the art, can also be any of the superhard abrasive materials, including, but not limited to, synthetic or natural diamond, cubic boron nitride, and wurtzite boron nitride as well as combinations thereof.

Also, the cemented metal carbide substrate refers to a carbide of one of the group IVB, VB, or VIB metals which is pressed and sintered in the presence of a binder of cobalt, nickel, or iron and the alloys thereof.

2. Prior Art

Composite polycrystalline diamond compacts, PCD, have been used for industrial applications including rock drilling and metal machining for many years. One of the factors limiting the success of PCD is the strength of the bond between the polycrystalline diamond layer and the sintered metal carbide substrate. For example, analyses of the failure mode for drill bits used for deep hole rock drilling show that in approximately 33 percent of the cases, bit failure or wear is caused by delamination of the diamond from the metal carbide substrate.

U.S. Pat. No. 3,745,623 (reissue U.S. Pat. No. 32,380) teaches the attachment of diamond to tungsten carbide support material. This, however, results in a cutting tool with a relatively low impact resistance. FIG. 1, which is a perspective drawing of this prior art composite, shows that there is a very abrupt transition between the metal carbide support and the polycrystalline diamond layer. Due to the differences in the thermal expansion of diamond in the PCD layer and the binder metal used to cement the metal carbide substrate, there exists a stress in excess of 200,000 psi between these two layers. The force exerted by this stress must be overcome by the extremely thin layer of cobalt which is the binding medium that holds the PCD layer to the metal carbide substrate. Because of the very high stress between the two layers, which is distributed over a flat narrow transition zone, it is relatively easy for the compact to delaminate in this area upon impact. Additionally, it has been known that delaminations can also occur on heating or other disturbances aside from impact. In fact, parts have delaminated without any known provocation, most probably as a result of a defect within the interface or body of the PCD which initiates a crack and results in catastrophic failure.

One solution to this problem is proposed in the teaching of U.S. Pat. No. 4,604,106. This patent utilizes one or more transitional layers incorporating powdered mixtures with various percentages of diamond, tungsten carbide, and cobalt to distribute the stress caused by the difference in thermal expansion over a larger area. A problem with this solution is that "sweep-through" of the metallic catalyst sintering agent is impeded by the free cobalt and the cobalt cemented carbide in the mixture.

U.S. Pat. No. 4,784,023 teaches the grooving of polycrystalline diamond substrates but does not teach the use of patterned substrate designed to uniformly reduce the stress between the polycrystalline diamond layer and the substrate support layer. In fact, this patent specifically mentions the use of undercut (or dovetail) portions of substrate grooves, which contributes to increased localized stress and is strictly forbidden by the present invention. FIG. 2 shows the region of highly concentrated stress that results from fabricating polycrystalline diamond composites with substrates that are grooved in a dovetail manner. Instead of reducing the stress between the polycrystalline diamond layer and the metallic substrate, this actually makes the situation much worse. This is because the larger volume of metal at the top of the ridge will expand and contract during heating cycles to a greater extent than the polycrystalline diamond, forcing the composite to fracture at locations 1 and 2 shown in the drawing.

The disadvantage of using relatively few parallel grooves with planar side walls is that the stress again becomes concentrated along the top and more importantly the base of each groove and results in significant cracking of the metallic substrate along the edges of the bottom of the groove. This cracking 3, shown in FIG. 3, significantly weakens the substrate whose main purpose is to provide mechanical strength to the thin polycrystalline diamond layer. As a result, construction of a polycrystalline diamond cutter following the teachings provided by U.S. Pat. No. 4,784,023 is not suitable for cutting applications where repeated high impact forces are encountered, such as in percussive drilling, nor in applications where extreme thermal shock is a consideration.

U.S. Pat. No. 4,592,433, which teaches grooving substrates, is not applicable to the present invention since these composites do not have a solid diamond table across the entire top surface of the substrate, and thus are not subjected to the same type of delamination failure. With the top layer of diamond not covering the entire surface, these composites cannot compete in the harsh abrasive application areas with the other prior art and present invention compacts mentioned in this patent application.

U.S. Pat. No. 4,629,373 describes the formation of various types of irregularities upon a polycrystalline diamond body without an attached substrate. The purpose of these irregularities is to increase the surface area of the diamond and to provide mechanical interlocking when the diamond is later brazed to a support or placed in a metal matrix. This patent specifically mentions that stress between the polycrystalline diamond and metal substrate support is a problem that results from manufacturing compacts by a one-step process. It, therefore, suggests that polycrystalline diamond bodies with surface irregularities be attached to support matrices in a second step after fabrication at ultra-high pressures and temperatures. This type of bond is, unfortunately, of significantly lower strength than that of a bond produced between diamond and substrate metals under diamond stable conditions. Therefore, compacts made by this process cannot be used in high impact applications or other applications in which considerable force is placed upon the polycrystalline diamond table.

It would be desirable to have a composite compact wherein the stress between the diamond and metal carbide substrate could be uniformly spread over a larger area and the attachment between the diamond and metal carbide strengthened such that the impact resistance of the composite tool is improved without any loss of diamond-to-diamond bonding that results from efficient sweep-through of the catalyst sintering metal.

SUMMARY OF THE INVENTION

The instant invention by modification of the topography of the surface of a sintered metal carbide substrate to provide irregularities with non-planar side walls evenly distributed over the entire area of the substrate in contact with the diamond, provides a solution to the aforementioned problem by providing a uniform stress gradient while at the same time increasing the area of attachment between the polycrystalline diamond and its metallic carbide substrate. The surface of the metal carbide substrate is changed from a flat two-dimensional area to a three-dimensional pattern in such a manner that the percentage of diamond in the composite can be varied continuously throughout the zone that exists between the metal carbide support and the polycrystalline diamond layer. The thickness of the transition zone can be controlled as well as cross sectional diamond percentage. The diamond percentage must always be higher toward the diamond end of the transition zone.

The surface topography of the metal carbide substrate can be patterned in a predetermined or random fashion; however, it is an important aspect of this invention that the irregularities in the surface, provided by the pattern, be in a relatively uniform distribution. This uniformity is necessary in order to evenly distribute the stresses which arise from the difference in thermal expansion between the diamond and the metal carbide support material.

BRIEF DESCRIPTION OF THE DRAWINGS

This invention will be better understood from the following description and drawings.

DESCRIPTION OF THE PREFERRED EMBODIMENTS

FIGS. 4, 5, 6, and 7 show embodiments of this invention. These views show the interface between the PCD diamond layer and the metal carbide support. The interface is not planar but has irregularities which are uniformly distributed throughout the cross section. These irregularities in the surface of the metal carbide result in an increase in the surface area of contact between the diamond crystals and the metal substrate. This increase in surface area provides a corresponding increase in the strength of attachment of the diamond layer to the substrate.

The most important aspect of this invention is that as a result of non-planar side walls of these surface irregularities, the distribution of internal stress is diffused vertically within the PCD composite compact, thus reducing the concentration of force which causes delamination between the polycrystalline diamond table and the substrate and substrate cracking in prior art composites. The interface between the layers is defined by a transition zone that has a topography with irregularities having non-planar side walls such that the concentration of substrate material continuously and gradually decreases at deeper penetrations into the diamond layer.

Figure 1:
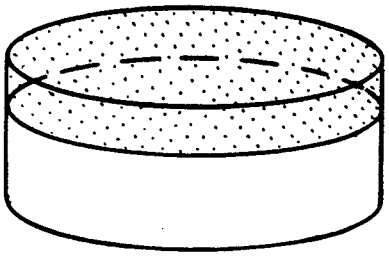
FIG. 1, previously mentioned, is a perspective view of a prior art PCD composite compact.
Figure 4:
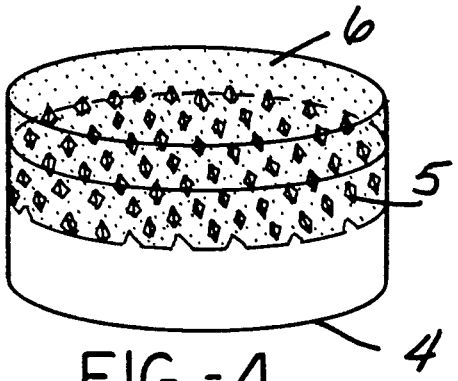
FIG -4 PRIOR ART
FIG. 4 shows a perspective view of a PCD composite made according to an embodiment of the present invention.
Figure 2:
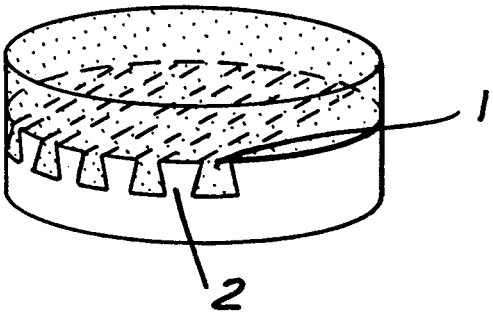
FIG. 2 is a perspective view of a prior art PCD that contains an integrally bonded substrate with undercut grooves at the diamond substrate interface.

The substrate 4 shown in FIG. 4 has surface irregularities 5 which are pyramidal in shape and penetrate approximately a quarter of the way into the total thickness of the polycrystalline diamond layer 6.

Figure 5:
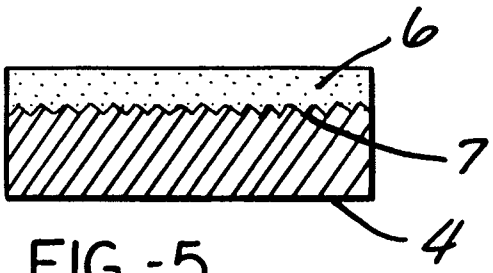
FIG. 5 shows a cross-sectional view of FIG. 2.

A schematic representation of a cross-sectional view of FIG. 4 is shown in FIG. 5.

Figure 6:
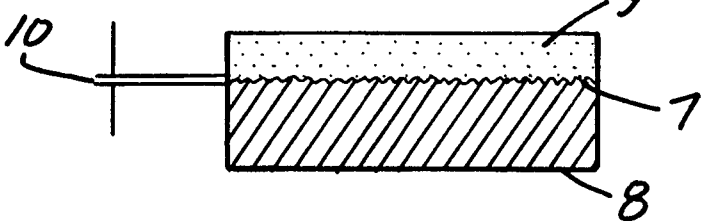
FIG. 6 shows a cross-sectional view of another embodiment of this invention wherein the surface of the metal carbide is modified to give a narrower transition zone between the PCD layer and the metal carbide substrate.

The cross-sectional view shown in FIG. 6 has surface irregularities 7 in the substrate 8 that protrude into the polycrystalline diamond layer 9 a distance of approximately one-half of that shown for the irregularities 5 of FIG. 5. This would provided a narrower transition zone 10 which would result in a less gradual distribution of stress between the diamond layer and the substrate support.

Figure 7:
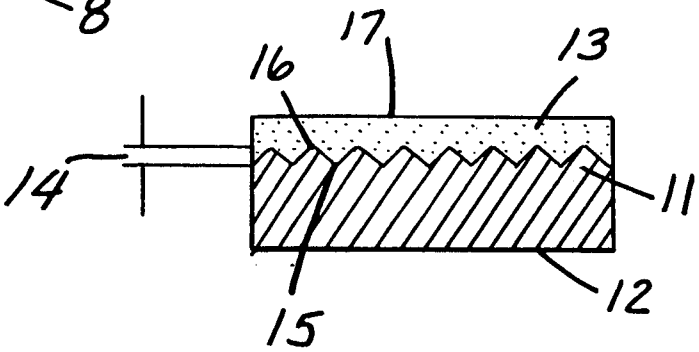
FIG. 7 shows a cross-sectional view of yet another embodiment of this invention wherein the surface of the metal carbide has been modified to give a broader transition zone between the PCD layer and the metal carbide substrate.

The cross-sectional view of a PCD composite, shown in FIG. 7, has surface irregularities 11 in the substrate 12 that penetrate into the polycrystalline diamond layer 13 a distance approximately twice that of the irregularities 5 illustrated in FIG. 5. The result of this topography is that the concentration of substrate material is gradually reduced at deeper penetrations into the diamond layer thus diffusing the internal stress vertically over a broader transition zone 14.

The invention can be better understood by further examination of FIG. 7 which shows the substrate 12 with surface irregularities having angularly disposed sidewalls in which the spacing between adjacent surface irregularities is less at the base 15 of such irregularities than at the top 16 and a polycrystalline material layer 13 having a cutting surface 17 with an opposed mounting surface joined to the substrate, the mounting surface having surface irregularities interlocked with the surface irregularities in the substrate.

The surface topography of the metal carbide substrate can be modified in any number of ways, such as grinding, EDM machining, grit blasting, or preforming prior to sintering. However, the pattern irregularity of the metal carbide substrate should be deep enough in order to spread the stress over a sufficiently thick enough zone to be meaningful and the pattern should have enough peaks to uniformly distribute the stress and to increase the surface area of contact between the diamond crystals and the metal carbide substrate sufficiently to give improved bonding.

The outer surface of the composite compact is comprised mostly of diamond. However, the use of cubic boron nitride and mixtures of diamond and cubic boron nitride can be substituted for the diamond layer in the previous description of the preferred embodiments to produce a compact for applications in which the chemical reactivity of diamond would be detrimental.

Figure 8:
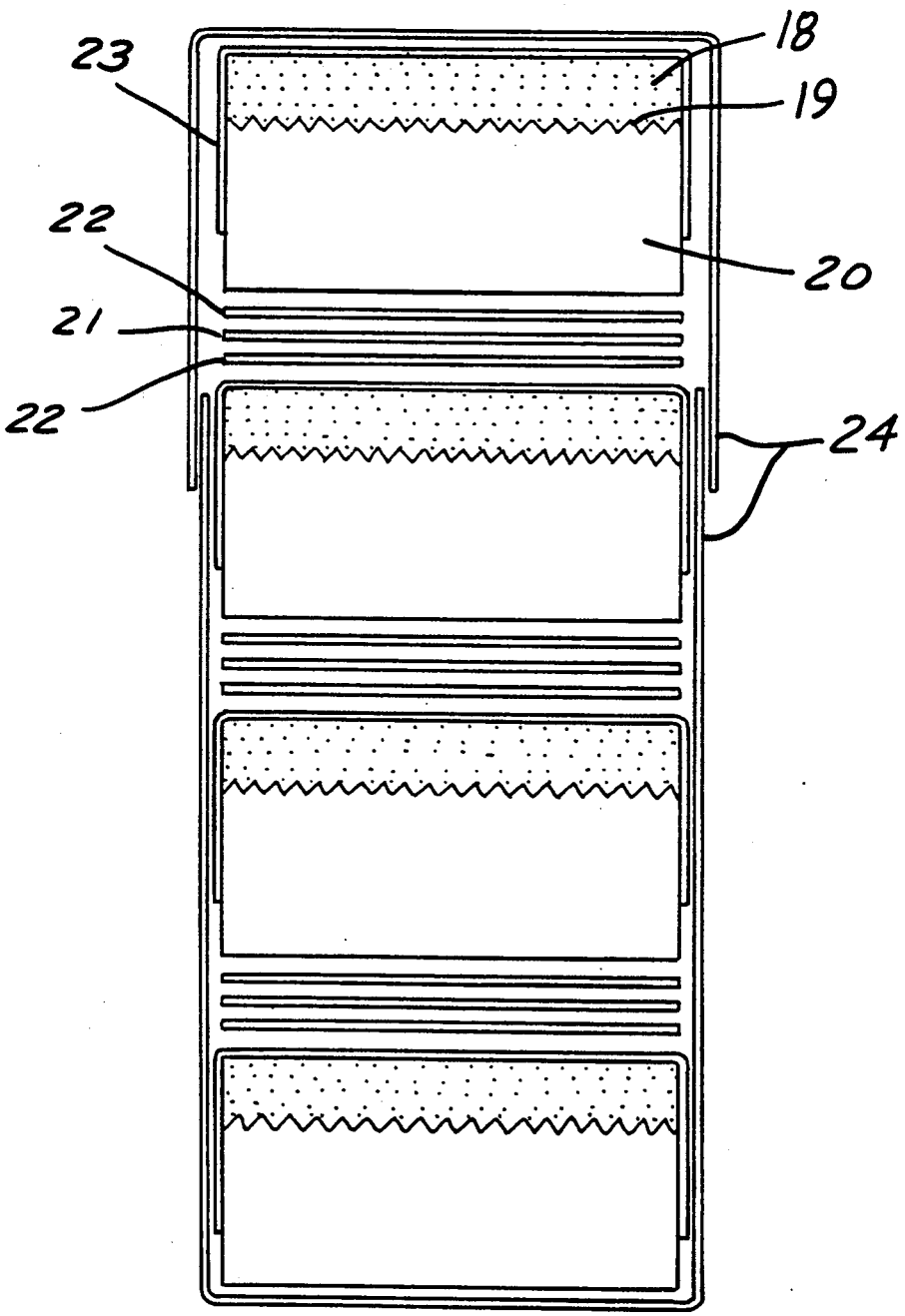
FIG. 8 is a cross-sectional view of a sample cell used to fabricate an embodiment of the present invention.
Figure 1:
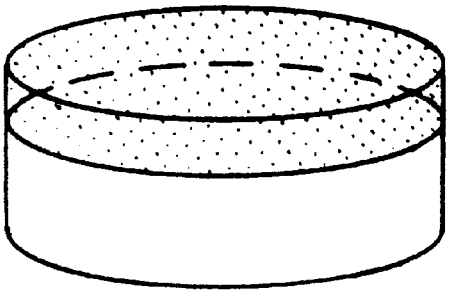
Figure 4:
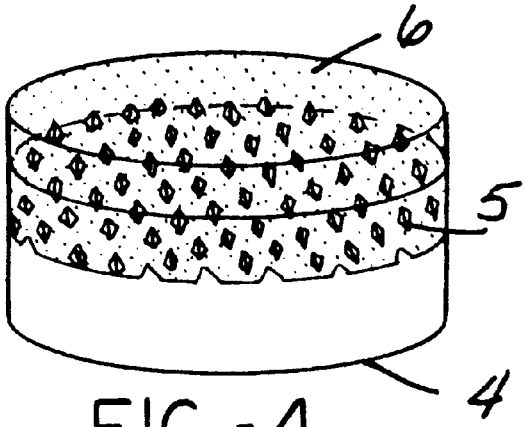
FIG -4 PRIOR ART
Figure 2:
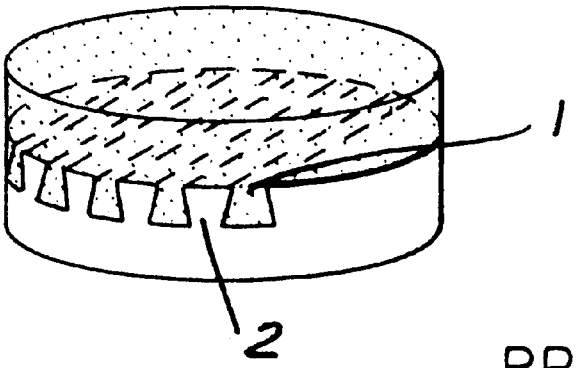
FIG -2 PRIOR ART

FIG. 8 shows a cross section of the inner portion of an assembly which may be employed to make the composite polycrystalline diamond body of the present invention. The inner portion is cylindrical in shape and is designed to fit within a central cavity of a ultrahigh pressure and temperature cell, such as that described in U.S. Pat. No. 3,745,623 or U.S. Pat. No. 3,913,280.

The outer enclosure 24 is composed of a metal such as zirconium, molybdenum, or tantalum, which is selected because of its high melting temperature and designed to protect the reaction zone from moisture and other harmful impurities present in a high pressure and high temperature environment. The cups 23 are also made of a metal such as zirconium, molybdenum, or tantalum and designed to provide additional protection to the sample if the outer enclosure should fail. It is preferable that one of the metals, either 23 or 24, be zirconium since this material will act as a "getter" to remove oxygen and other harmful gases which may be present. The discs 22 are fabricated from either zirconium or molybdenum and disc 21 is composed of fired mica, salt, boron nitride, or zirconium oxide and is used as a separator so that the two composite bodies can be easily divided. The substrate 20 is composed preferably of cemented tungsten carbide with a cobalt binder and its surface 19 contains the pattern irregularities previously described. These irregularities may be formed on the surface of the substrate in any number of ways. They can be molded into the surface of an unsintered metal carbide substrate prior to sintering. If the carbide substrate is precemented, the irregularities may be cut into the surface using conventional techniques, such as grinding, EDM, etching, etc.

Single crystal diamond 4 is preferably a good quality metal bond diamond that has been carefully selected and sized. It is important that this diamond be cleaned to remove any surface contamination that may interfere with the sintering process. Also, it is important that the diamond layer be free from other materials so that voids exist between the diamond crystals to allow cobalt from the metallic carbide substrate on heating under ultra high pressure conditions to sweep through these voids and carry any remaining impurities ahead of the wave front that is performing the sintering action. Particle size of the diamond that is used ranges from 1 to 100 microns.

Typically, the metal carbide support will be composed of tungsten carbide with a 13 weight percent cobalt binder.

The entire cell is subjected to pressures in excess of 40 K-bars and heated in excess of 1400° C. for a time of 10 minutes. Then the cell is allowed to cool enough so that the diamond does not back-convert to graphite when the pressure is released.

After pressing, the samples are lapped and ground to remove all the protective metals 22, 23, and 24.

Finished parts are mounted on to tool shanks or drill bit bodies by well-known methods, such as brazing, LS bonding, mechanical interference fit, etc., and find use in such applications as percussive rock drilling, machining materials with interruptive cuts such as slotted shafts, or any application where high impact forces and/or thermal stress may result in delamination of the diamond layer from conventional PCD compacts.

EXAMPLES

Example 1

One gram of 120/140 mesh metal bond diamond, which has been treated in a vacuum at 800° C. for one hour, is placed in a molybdenum cup. A cobalt cemented tungsten carbide substrate with a checkered pattern on one surface consisting of slots, ground with a V-shaped diamond wheel, at right angles to each other, 0.020-inch wide by 0.020-inch deep and spaced 0.020-inch apart, is placed on top of the diamond with the slotted side adjacent to the diamond crystals. This assembly is then loaded into the high pressure cell, depicted in FIG. 8, and pressed to 45 K-bars for fifteen minutes at 1450° C. After cutting the power to the cell and allowing the cell to cool at high pressure for one minute, the pressure is released. The composite bodies are removed from the other cell components and then lapped and ground to final dimensions.

The final polycrystalline diamond composite is placed in a fixture designed to apply a shear force parallel to the diamond-carbide substrate interface. Application of such force will show that it is extremely difficult to obtain fracture between the polycrystalline diamond layer and the cobalt cemented tungsten carbide support substrate. Composites fabricated in this manner can be used in tool applications where impact forces cause excessive damage to prior art polycrystalline diamond composites.

Additional testing by use of these composites to machine hard rock, such as Barre granite, can be performed to show that the abrasive wear resistance is superior to that of prior art composites fabricated by methods taught in U.S. Pat. No. 4,604,106. In performing this test, one should compare test results by machining with composites that are fabricated using diamond of equivalent particle size.

Example 2

A one gram sample of 120/140 mesh metal bond diamond is placed in a molybdenum cup. A cobalt cemented tungsten carbide substrate with a pattern consisting of pyramidal projections, produced by grinding the surface with a V-shaped diamond wheel, is used. The pattern is produced by grinding slots at right angles to each other with a V-shaped diamond wheel such that the grooves are 0.030-inch deep. All other conditions are the same as for Example 1 above.

Example 3

Eight hundred milligrams of 325/400 mesh metal bond diamond is placed in a molybdenum cup. A cobalt cemented tungsten carbide substrate with a pattern consisting of pyramidal projections, produced by grinding the surface with a V-shaped diamond wheel, is used. The pattern is produced by grinding slots at right angles to each other with a V-shaped diamond wheel such that the grooves are 0.020-inch deep. All other conditions are kept the same as shown for Example 1 above.

Test results for samples prepared in this manner should be similar to those for Examples 1 and 2, except that there is a significant increase in the wear resistance as shown by the machining of Barre granite. This is, of course, a direct result of using a finer mesh diamond as a starting material and such observations are well known in the art.

What is claimed is:

1. A cutting element comprising:

a substrate having a first surface;

the first surface being formed with surface irregularities having angularly disposed sidewalls in which the spacing between adjacent surface irregularities is less at the base of such irregularities than at the top end of such irregularities at the first surface of the substrate; and a polycrystalline material layer having a cutting surface and an opposed mounting surface joined to the substrate, the mounting surface having surface irregularities complimentary to and contacting the surface irregularities in the substrate; and wherein the concentration of the higher thermal expansion material substrate continuously and gradually decreases from the substrate into the lower thermal expansion polycrystalline material layer through the region of the surface irregularities.

2. The cutting element of claim 1 wherein the polycrystalline material layer is formed of diamonds.

3. The cutting element of claim 1 wherein the polycrystalline material layer is formed of cubic boron nitride.

4. The cutting element of claim 1 wherein the polycrystalline material layer is formed of a mixture of cubic boron nitride and diamonds.

5. The cutting element of claim 1 wherein the maximum height of the surface irregularities in the substrate is less than or equal to the thickness of the polycrystalline material layer.

6. The cutting element of claim 1 wherein the surface irregularities are uniformly distributed over the surface of the substrate.

* * * * *

US005011515B1

REEXAMINATION CERTIFICATE (3800th)

United States Patent [19]

Frushour

[11] B1 5,011,515

[45] Certificate Issued Jul. 6, 1999

[54] COMPOSITE POLYCRYSTALLINE DIAMOND COMPACT WITH IMPROVED IMPACT RESISTANCE

[76] Inventor: Robert H. Frushour, P.O. Box 818, Plymouth, Mich. 48170

Reexamination Requests:
No. 90/004,686, Jul. 3, 1997
No. 90/004,930, Feb. 27, 1998

Reexamination Certificate for:

| | |
|---|---|
| Patent No.: | **5,011,515** |
| Issued: | **Apr. 30, 1991** |
| Appl. No.: | **07/390,208** |
| Filed: | **Aug. 7, 1989** |

[51] Int. Cl.[6] ..... E21B 10/46

[52] U.S. Cl. ..... 51/307; 51/309; 407/118; 407/119; 175/420.2; 175/428; 175/433; 175/434

[58] Field of Search ..... 407/116–120; 51/293, 295, 307–309; 408/145; 175/420.2, 428, 432–434

[56] References Cited

U.S. PATENT DOCUMENTS

| | | | |
|---|---|---|---|
| Re. 32,380 | 3/1987 | Wentorf | 407/119 |
| 1,974,215 | 9/1934 | Kilmer | 407/118 |
| 2,944,323 | 7/1960 | Stadler | 407/119 |
| 3,745,323 | 7/1973 | Wentorf, Jr. et al. | 407/119 |
| 4,109,737 | 8/1978 | Bovenkerk | 175/329 |
| 4,592,433 | 6/1986 | Dennis | 51/309 |
| 4,604,106 | 8/1986 | Hall et al. | 51/293 |
| 4,626,407 | 12/1986 | Veltri et al. | 407/119 |
| 4,629,373 | 12/1986 | Hall | 407/118 |
| 4,646,857 | 3/1987 | Thompson | 175/329 |
| 4,716,975 | 1/1988 | Dennis | 407/118 |
| 4,784,023 | 11/1988 | Dennis | 407/119 |
| 4,972,637 | 11/1990 | Dyer | 51/295 |

FOREIGN PATENT DOCUMENTS

| | | | |
|---|---|---|---|
| 114025 | 6/1940 | Australia | 407/118 |
| 2333602 | 8/1977 | France | 407/118 |

*Primary Examiner*—Steven C. Bishop

[57] ABSTRACT

A compact blank for use in operations that require very high impact strength and abrasion resistance is disclosed. The compact comprises a substrate formed of tungsten carbide or other hard material with a diamond or cubic boron nitride layer bonded to the substrate. The interface between the layers is defined by topography with irregularities having non-planar side walls such that the concentration of substrate material continuously and gradually decreases at deeper penetrations into the diamond layer.

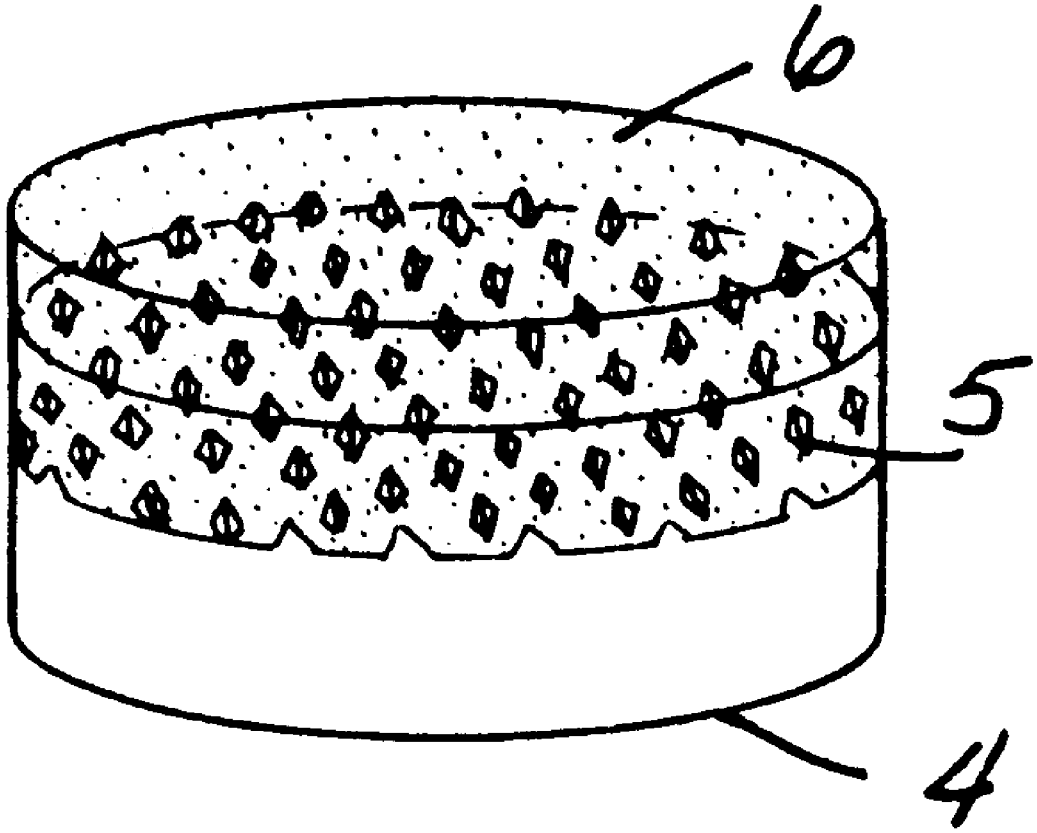

Figure 3:
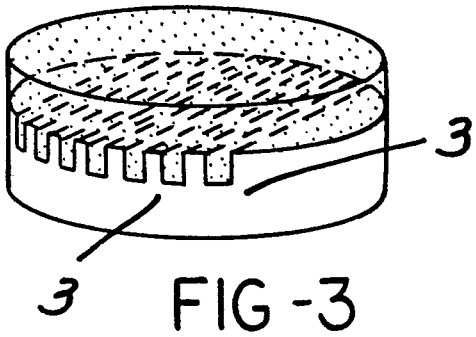
FIG. 3 is a perspective view of a prior art composite which is similar to that shown in FIG. 2, except that the side walls of the substrate grooves are perpendicular to the top surface of the compact instead of being undercut.

PRIOR ART
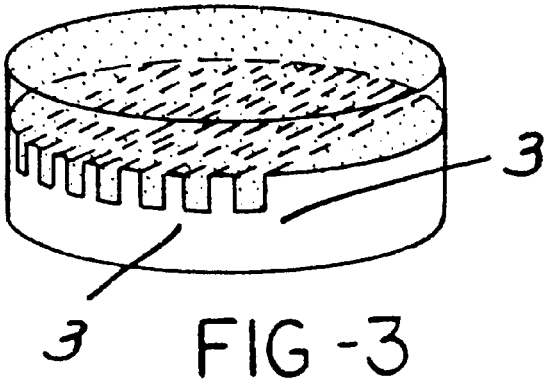
FIG -3
AMENDED

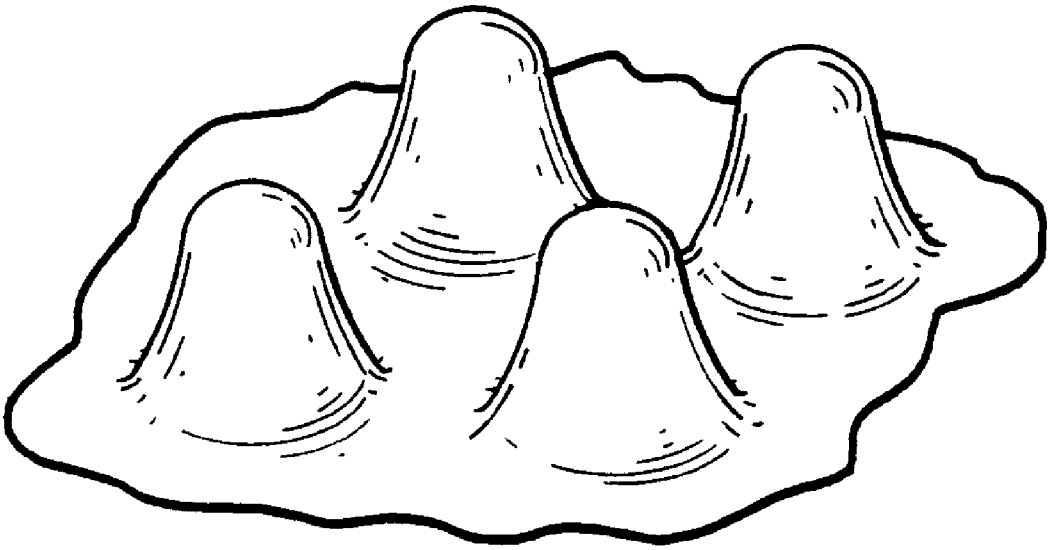
FIG - 9
NEW

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, lines 1–2:

FIG. 8 is a cross-sectional view of a sample cell used to fabricate an embodiment of the present invention*; and*

*FIG. 9 is a partial view of a non-planar sidewall surface irregularity.*

Column 4, lines 17–29:

The most important aspect of this invention is that as a result of non-planar side walls of these surface irregularities, *shown in FIG. 9,* the distribution of internal stress is diffused vertically within the PCD composite compact, thus reducing the concentration of force which causes delamination between the polycrystalline diamond table and the substrate and substrate cracking in prior art composites. The interface between the layers is defined by a transition zone that has a topography with irregularities having non-planar walls such that the concentration of substrate material continuously and gradually decreases at deeper penetrations into the diamond layer.

THE DRAWING FIGURES HAVE BEEN CHANGED AS FOLLOWS:

Legend "Prior Art" added to FIG. 3, "New" FIG. 9 added.

AS A RESULT OF REEXAMINATION IT HAS BEEN DETERMINED THAT:

Claims 1 and 5 are determined to be patentable as amended.

Claims 2–4 and 6, dependent on an amended claim, are determined to be patentable.

New claims 7–15 are added and determined to be patentable.

1. A cutting element comprising:

a substrate having a first surface;

the first surface being formed with surface irregularities having [angularly disposed] *non-planar* sidewalls *spaced two dimensionally across the first surface* in which the spacing between adjacent surface irregularities is less at the base of such irregularities than at the top end of such irregularities at the first surface of the substrate; and a polycrystalline material layer having a cutting surface and an opposed mounting surface joined to the substrate, the mounting surface having surface irregularities complimentary to [and contacting] the surface irregularities in the substrate; and wherein the concentration of the higher thermal expansion material substrate continuously and gradually decreases from the substrate into the lower thermal expansion polycrystalline material layer through the region of the surface irregularities.

5. The cutting element of claim 1 wherein the maximum height of the surface irregularities in the substrate is less then [or equal to] the thickness of the polycrystalline material layer.

*7. The cutting element of claim 1 wherein:*

*two adjacent sidewalls of each surface irregularity meet to define a common edge projecting from the base of the surface irregularity to the top edge of each surface irregularity in which the spacing between adjacent surface irregularities is less at the base of such surface irregularities than at the top end of such surface irregularities.*

*8. The cutting element of claim 1 wherein the surface irregularities are three dimensional surface irregularities.*

*9. The cutting element of claim 1 wherein the plurality of surface irregularities are each spaced two dimensionally from all adjacent surface irregularities across the first surface.*

*10. The cutting element of claim 1 wherein the surface irregularities are arranged in a two dimensional grid on the first surface.*

*11. The cutting element of claim 1 wherein:*

*the surface irregularities are disposed in more than one non-parallel direction on the first surface.*

*12. The cutting element of claim 1 wherein the concentration of the higher thermal expansion material substrate decreases in more than one direction across the first surface.*

*13. The cutting element of claim 1 wherein the concentration of the higher thermal expansion material substrate decreases at least bi-directionally across the first surface.*

*14. The cutting element of claim 1 wherein the surface irregularities include sidewalls opposing adjacent surface irregularities in at least two directions extending perpendicular with respect to one another.*

*15. The cutting element comprising:*

*a substrate having a first surface;*

*the first surface being formed with surface irregularities having angularly disposed sidewalls in which the spacing between adjacent surface irregularities is less at the base of such irregularities than at the top end of such irregularities at the first surface of the substrate;*

*a polycrystalline material layer having a cutting surface and an opposed mounting surface joined to the substrate, the mounting surface having surface irregularities complementary to and contacting the surface irregularities in the substrate; and wherein;*

*the sidewalls of the surface irregularities define means for continuously and gradually decreasing the concentration of the higher thermal expansion material in an outwardly extending direction from the substrate into the lower thermal expansion polycrystalline material layer through the region of the surface irregularities in three dimensions.*

* * * * *